United States Patent [19]

Menegus

[11] 4,047,493

[45] Sept. 13, 1977

[54] AUTOMATICALLY ROTATABLE SLOOP RIG

[76] Inventor: Robert L. Menegus, 62 Major St., Clifton, N.J. 07013

[21] Appl. No.: 747,162

[22] Filed: Dec. 3, 1976

[51] Int. Cl.[2] ..... B63H 9/04

[52] U.S. Cl. ..... 114/102; 114/39

[58] Field of Search ..... 114/39, 102, 103, 104–107

[56] References Cited

U.S. PATENT DOCUMENTS

| | | | |
|---|---|---|---|
| 2,893,339 | 7/1959 | Ram | 114/39 |
| 3,867,894 | 2/1975 | Vicard | 114/102 |
| 3,968,765 | 7/1976 | Menegus | 114/102 |

FOREIGN PATENT DOCUMENTS

| | | | |
|---|---|---|---|
| 1,423,958 | 11/1964 | France | 114/39 |

*Primary Examiner*—Trygve M. Blix
*Assistant Examiner*—Stuart M. Goldstein
*Attorney, Agent, or Firm*—James J. Cannon, Jr.; James J. Cannon

[57] ABSTRACT

An apparatus for mounting a jibsail and a mainsail on a sloop, the structure including a step assembly bedded to the hull and supporting conventional roller and ball bearings; a mast spreading the mainsail; a generally horizontal boom located close above deck and rotating freely about the step; a forespar rotatable about its own axis and extending from high up on the mast to said boom, spreading the jibsail; and rigging connecting the jib and mainsail with said boom. The spars, sails, and cord rigging are freely rotatable on the bearings as a unit about the step as the wind deviates in direction. The rotatable spar-frame allows the sails to respond directly and accurately to shifting winds without requiring repeated manual adjustments, so that the orientations of the sails with respect to the direction of the apparent wind may be voluntarily set, and once set remain constant while the sails operate below stall, in order, first, to provide maximum thrust with minimum drag for sailing to windward and, second, to provide for automatic going about and jibing and sailing on any possible point by manning only the helm.

7 Claims, 24 Drawing Figures

AUTOMATICALLY ROTATABLE SLOOP RIG

BACKGROUND OF THE INVENTION

1. Field of the Invention

This invention relates to sailboats, specifically to an apparatus for mounting a jibsail and mainsail on a sloop, so that the entire rig may rotate to follow the shifting wind or to compensate for the helmsman's maneuvers.

2. Description of the Prior Art

The prior patent art does not teach the detailed structure of automatically rotatable sailing rigs. In his U.S. Pat. No. 3,968,765, the inventor described the aerodynamics and claimed the automatically rotatable sail rig. A principal advantage is that its thrust is reliably adjustable over a wide range in a steady wind; said thrust, being voluntarily set, is substantially unaffected by possible errors at the helm and by the directionally-shifting wind. Another advantage is its inherently high lift/drag ratio at angles of attack below stall, which is the condition to the windward. Another advantage is its ability to sail on any possible point, stalled or not, without adjusting sheets when changing course.

Many fore and aft sails have heretofore been twisted too much in moderate to strong winds, and their proximity to other sails also has deleteriously affected performance; forward drive has been reduced and lateral wind force has been unnecessarily high. Being fixed with respect to the hull, conventional sails commonly luff and stall by turns in the deviating wind, resulting in decreased thrust and increased drag.

SUMMARY OF THE INVENTION

This improved structure for sloop rigs permits shaping sails and adjusting their juxtaposition, thus accurately controlling their aerodynamic parameters. When operating below stall, the sails trim themselves to the shifting wind, rather than being adjusted repeatedly by the sailor.

The automatically rotatable sloop rig of U.S. Pat. No. 3,968,765 utilizes a novel boom (carrier boom) which rotates freely about a centrally located step, even when the sloop is heeled. Said carrier boom herein mounts two airfoils, one before and the other aft of the step. These airfoils are adjustable about their vertical axis of rotation, and therefore are quickly fixed at chosen angles with respect to the carrier boom, and not with respect to the hull proper. Under the force of the wind, the entire assembly of carrier boom, airfoils and associated rigging rotates about the step to assume a desired boom attitude with respect to the apparent wind. Each airfoil operates at its desired angle of attack in the wind regardless of the attitude of the hull proper.

On a beat to windward, a close reach, and a beam reach, the average angle of attack on the airfoils is a function only of the foil-boom angles set voluntarily. If the sailor wishes to increase the angle of attack, to increase the thrust, he draws in all the sail sheets. These sheets pass down from the rig to the hull in the immediate vicinity of the step, whereby rotation of the entire rig does not affect the foil-boom angles set by hand. No matter how the sailor performs at the helm (within a range of relative wind angle), the effective angle of attack and the concommitant thrust remain fixed, because the force of the wind keeps the rig at a fixed wind-attitude while the boat turns underneath. The automatically rotatable sail rig operates by always balancing the moments of the horizontal sail forces about the vertical axis of the freely rotating step. One object of the present work is to specify spars and rigging to shape the sails and permit the rig to respond to the wind by rotating bi-directionally according to the foregoing considerations.

The desired and efficient local form of any sail depends on water course, water speed relative to wind speed and the height of the sail above the water. Accordingly the well tuned sail is twisted through a small controlled angle determined by the shifting true wind, and its variable orientation with respect to other sails is determined by the same course, speed, and height. Controlling said shapes and mutual orientations by exerting appropriate forces readily adjustable imposes absent loads on the spars. Means are specified for coping with these augmented forces, yet limiting the inertia of the rig. These specific means are a further development of the inventor's prior U.S. Pat. No. 3,968,765.

The mainsail of the conventional sloop rig has been commonly twisted to an undesirable degree because it has been impossible to pull sufficient tension on the leech. The crews of large yachts sometimes set powerful vangs and the sheet to pull the mainsail boom downward, but this vertical force is limited by the allowable strain on the mast, and applying this force is inconvenient and often impractical when course changes are frequent. These same comments apply with less emphasis to the jib of a sloop. The overall effect has been loss of potential speed or wasted sail area. Often the foot of the sail has been stalled (too high attack) while the head has been flagging (no attack).

The present structure is a compromise between the aerodynamic ideal and acceptable weight or roll moment of inertia. For excess weight above the hull's metacenter defeats the purpose of shaping the sails.

The twist of a sail must be quickly and easily adjustable. This may be accomplished in part by varying tension on the mainsail leech, since the wind force varies over a wide range and the required lateral deflection of the leech also depends on the water course with respect to the true wind. The lowest twist and therefore a sometimes high leech tension is required when the sloop sails close on the wind, when the heeling force is a maximum. The prime objective is to maximize the ratio of water speed to relative wind speed at an acceptable heel angle in weather that permits coordinated sailing.

The fundamental reason why a minor sail twist is permissable and necessary is that the wind velocity in the turbulent air boundary layer above water varies approximately as the fourth root of height up to a few thousand feet or less. Since the sloop's water speed while sailing on the wind may be about half the true wind speed measured at the height of the main truck, the angle of relative wind off water course varies from nearly zero at the water surface to thirty degrees at the head of the sail, and said required twist between sail foot and head is about five degrees if one operates with the angle of attack invariant with the height. However, because of the proximity of the foot to the water surface the angle of attack should be allowed to decrease with height by a degree or two, so that the total twist is 6° or 7°. This means that the horizontal deflection of the leech is to be 1 to 2 percent of the leech length when sailing close on the wind. Two or three times more deflection is appropriate when sailing on the beam reach.

A leech tension of about 2.6 times the mainsail air force is needed to achieve the correct mainsail shape. This "vertical" force is applied to the after end of the mainsail boom by means of a conventional vang between said boom and a bearing near the foot of the step in order to allow the sail to rotate about the step and yet maintain its shape. Because the mainsail boom is conventionally located close above deck, the leech force is multiplied on the vang by reason of mechanical disadvantage. In turn, the horizontal component of the vang tension places a similarly high axial compressive load on the mainsail boom. A step structure is installed to resist these sometimes high forces and to accomodate suitably light bearings rotating about the mast. The structure of the step assembly is built fairly stiff to permit reliable performance of the bearings, imposing only a minor penalty in the way of increased roll moment of inertia. The step assembly permits the rig to rotate freely. The mast is inserted within a step housing, which is supported by three hull-bedded struts. At the top of the step housing is the main bearing assembly which comprises upper and lower thrust bearings to resist vertical forces and a radial bearing between said thrust bearings to resist horizontal forces, said main bearing assembly being external to the step housing. The mainsail boom is connected to the main bearing by means of a load spreader. A rotatable compression strut transmits a vertical force from the vang to the upper thrust bearing. The carrier boom also rotates about the main bearing just above the lower thrust bearing. The carrier boom rotates with respect to the outer race of the main bearing only when the mainsail foilboom angle is adjusted by hand. The step assembly also has a second bearing assembly, similar to the main radial bearing in construction, at the base of the step housing near the hull structure. It is to this lower bearing that the vang is attached and to which the rotatable compression strut is attached.

The forespar is a beam loaded with a distributed sail force varying from zero at the head to a maximum near its second jib sheet. This spar is lightened by means of tension stays, and it rotates in loose bearings at the head and foot. The function of said spar is to spread the jibsail, and to permit sail shape to be controlled by multiple jib sheets. Also, when going about, the jib is unrestrained so that it may change tack without manual adjustments to the sheets. (The conventional headstay, which mounts the genoa jib, is often badly deflected, since it is a cable. This deflection causes compounded difficulty in shaping the jibsail.)

At the mast head, the aft horizontal component of the mainsail leech tension is opposed by the tension on the forestay, and thus the mainsail leech and forestay together put a compressive load on the mast amounting to 5.4 times the mainsail air force. These forces are in addition to the usual compressive load and bending moment on the mast by both sails and weather shrouds. In sum, the axial compressive load on the mast is increased by about seventy percent through controlling the twist of the mainsail on the most severe sailing point.

The jib twist is controlled by multiple sheets and their tensile forces are small compared to those imposed by the mainsail.

Sheets are arranged to be all operated from a single tackle or winch. Or, the multiple jib sheets can be ganged as a unit separate from the main sheet, at the preference of the sailor. All sheets, or only the jib sheets, may be freed quickly in the event of emergency, to reduce sail thrust promptly.

On a run before the wind, or a broad reach, with stalled airfoils, the shape of battened sails has only minor influence. The mainsail leech may then be slacked off. Any subsidiary cloth that may be flown is at least marginally effective in dragging the boat, and sailors presume the bigger the better, which is not far from true provided the large cloth is manageable. If one does not fly a spinnaker (or ballon or reacher) in normal weather, he should delay turning into the run, while tacking downwind at non-stall, until the mark bears about 45° off the lee bow. The figure 45° could be locally refined, especially for the case of a long run when there may occur appreciable wind shift. It averages:

Lay Angle = ArcCosine ((Water Speed, Run)/(Water Speed, Broadest Reach permitting Non-Stall)) (1)

As Forumla 1 implies, in heavy weather the Cosine above is unity or nearly so, sail shape is a relatively minor issue, and the speediest downwind course is straight for the mark, regardless of what sail may be carried safely and in spite of short periods sailed by the lee.

The rotatable rig of U.S. Pat. No. 3,968,765 follows the fickle wind with its transient pressures and veerings more efficiently than can a sailor. Hence, for rudder automatic control, a stick bored with numerous holes can be used to link the carrier boom with the extended helm. Though possibly slowing response of the sensing and steering system, a rig thus equipped concomitantly attenuates and filters out low-amplitude, transient deviations, for as a sensing device the rig has comparatively huge chords and area. For the air in the downwash from any sail is straighter, or less oscillatory, than the relative wind as measured by a vane-actuated rudder controller whose wind vane is comparatively small.

Yet the usual gradual wind veerings over amplitudes of five to ten degrees are followed accurately by a boat using practically any gain on the helm when the helm is linked to the carrier boom.

With its helm clamped over appropriately, a boat equipped with the automatically rotatable rig, and provided its keel is of sufficient draft, circles repeatedly, going about and jibing automatically. Also, either with rudder automatic control, or with a clamped helm, the boat may be reliably hove to, regardless of the efficiency of its keel system.

In crowded water, the automatically rotatable rig could be operated as a conventional sloop by constraining the carrier boom straight fore and aft with two preventers. With the rig thereby constrained, a sailor is much less apt to cause a collision, for the sails no longer draw well on all possible points and so may be luffed up over a wider range of azimuthal angle.

The sail sheets are important to the desired operations described in the foregoing disclosure. They are used to set the two foil-boom angles and thus determine the sails' angles of attack, and for this purpose sails are sheeted to the freely rotatable carrier boom, and not to the hull as on the conventional sloop. As the automatically rotatable rig rotates to follow the wind, the geometric angle of attack, when below stall, remains fixed. The helmsman does not have to act according to tradition to maintain the angle of attack, though he nevertheless steers to take advantage or cope with the shifting wind, unless the steering function is taken over by the rudder automatic controller.

In summary, this is an automatically rotatable sail apparatus for a sloop comprising: a single vertical tubular mast assembly supporting a battened cloth mainsail along its luff; a substantially horizontal carrier boom freely rotatable about the vertical axis of the mast; a rotatable inclined tubular forespar assembly mounted at its lower extremity on the fore end of the carrier boom and at its upper extremity on the mast head, said forespar supporting a battened cloth jibsail along its luff; a tubular mainsail boom to accommodate the foot of the mainsail; a freely rotatable, stiff step structure including pairs of radial and thrust bearings bedded to the hull near the foot of the mast, said step structure mounting the rotatable spar frame including mast, carrier boom, forespar, and mainsail boom; a vang, to pull a weather-varying tension on the leech of the mainsail, being made fast at its extremities to the mainsail boom and to the lower bearing of the step structure; a main sheet between the mainsail boom and the carrier boom to control the azimuthal angle of the mainsail with respect to the rotatable carrier boom (not with respect to the hull); a coordinated system of multiple jib sheets made fast to jib battens to shape the jib sail generally and to control the azimuthal angle of the jib sail entirely over its surface with respect to the carrier boom as the corresponding mainsail is similarly controlled by the main sheet; a forestay set from the mast head to the nose of the hull to resist the horizontal component of tension imposed on the mainsail leech; and athwartships shrouds to support the mast. The forestay and shrouds are flexibly anchored to permit the free rotation of the entire apparatus of spars, sails, vang, sheets and halyards.

DESCRIPTION OF THE PREFERRED EMBODIMENT

Figure 1:
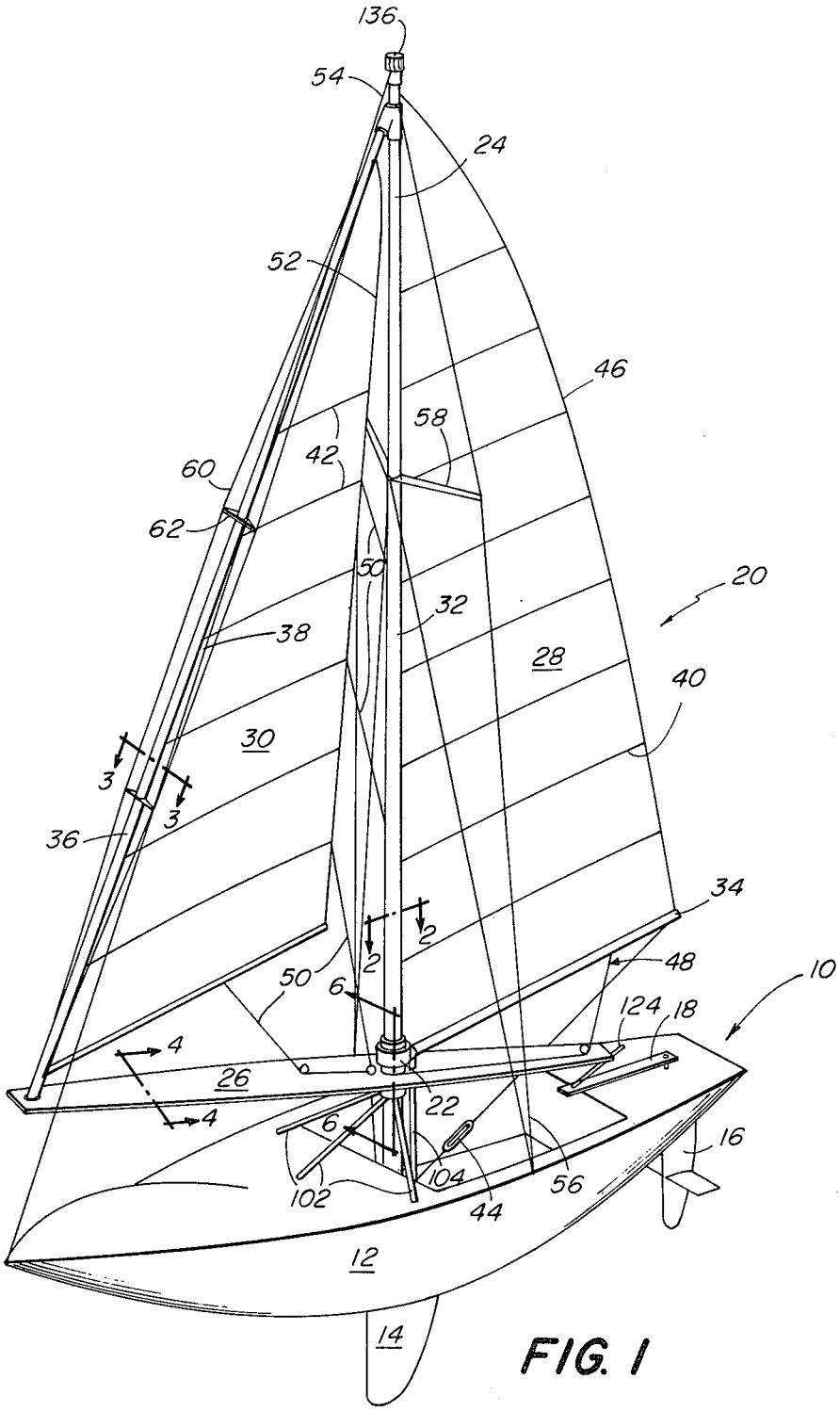
FIG. 1 is a side perspective view of a sloop rigged in accordance with the principles of U.S. Pat. No. 3,968,765.

FIG. 1 is a side perspective view of a yacht using the automatically rotatable sloop rig. Yacht 10 includes a hull 12 having a keel 14, a rudder 16, a helm 18 and the automatically rotatable sail rig, designated generally by the reference numeral 20. Rig 20 includes a centrally located, stiff step structure 22, described in detail hereinafter. A tubular vertical mast assembly 24 is mounted within said step structure 22. A horizontal carrier boom 26 is mounted to and rotates freely about said step structure 22 and consequently said carrier boom 26 is freely rotatable about the vertical axis of said mast assembly 24, even when sloop 10 is heeled. Said carrier boom 26 mounts, fore and aft of step structure 22 two airfoils: a mainsail 28 aft of the step structure 22, and a jibsail 30 forward of the step structure 22. Mast assembly 24 supports mainsail 28 along its luff 32. A tubular mainsail boom 34 accommodates the foot of mainsail 28. Rig 20 further includes a freely rotatable, inclined tubular forespar assembly 36 mounted at its lower extremity on the fore end of carrier boom 26 and at its upper extremity on the head of mast assembly 24. Said forespar assembly 36 supports jibsail 30 along its luff 38. Both mainsail 28 and jibsail 30 are battened cloth sails, the mainsail battens being indicated by the reference numeral 40 and the jibsail battens by numeral 42.

Rig 20 further includes a vang 44 used to pull a weather-varying tension on the leech 46 of mainsail 28, vang 44 being made fast at its extremities on mainsail boom 34 and to the lower bearing of step structure 22. A main sheet 48 connects the mainsail boom 34 to the carrier boom 26 to control the azimuthal angle of the mainsail boom 34 with respect to the carrier boom 26. A coordinated system of multiple jib sheets 59 are made fast to the jib battens 42 along the leech 52 to shape the jibsail 30 generally and to control the azimuth angle of jibsail 30 over its surface simultaneously with respect to the carrier boom 26 as the corresponding mainsail 28 angle is controlled by main sheet 48. Rig 20 further includes a forestay 54 from the head of mast 24 to the nose of hull 12 to resist the horizontal component of tension on leech 46 of mainsail 28, and athwartships shrouds 56 to support the mast 24. Shrouds 56 are held in position by spreaders 58. The forespar assembly 36 also includes bands 60 separated by spreaders 62. As shown in FIG. 1, forestay 54 and shrouds 56 are flexibly anchored to permit free rotation of the entire apparatus of spars, sails, vang, sheets and halyards.

Figure 2:
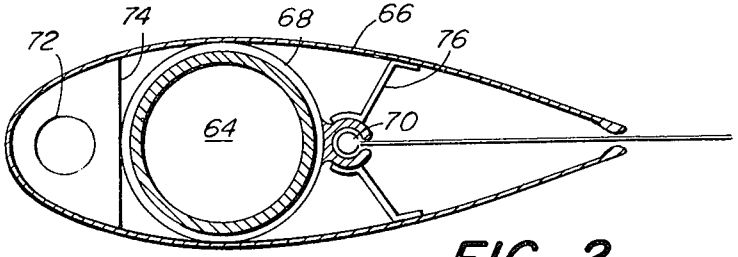
FIG. 2 is a cross-sectional view of the mast taken along the line 2 — 2 of FIG. 1.

FIG. 2 is a cross-sectional view of mast assembly 24. Assembly 24 includes a tubular spear 64, whose wall thickness decreases with its height, enclosed by a fairing case 66 which rotates about said spar 64. Loose fitting rings 68 are utilized to permit free rotation of fairing case 66. Fairing case 66 encloses from the elements the mainsail track 70, the main halyard, jibsheets 50 in opening 72, and other auxiliary lines. Fairing case 66 is strengthened by ribs 74 and braces 76.

Figure 3:
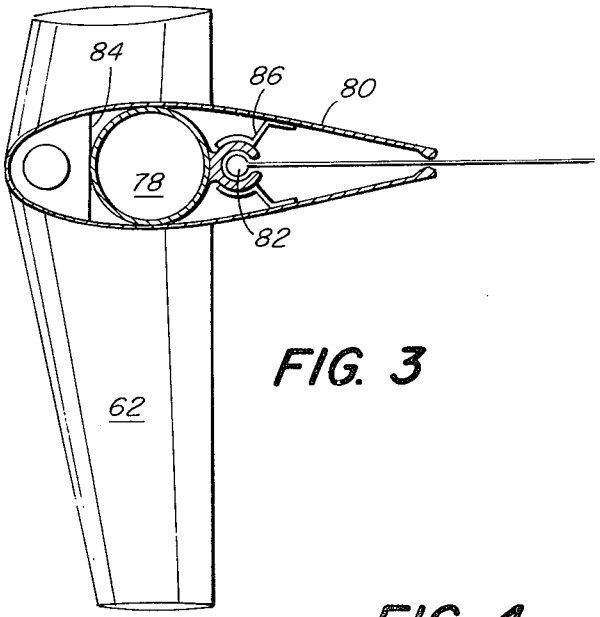
FIG. 3 is a cross-sectional view of the forespar taken along the line 3 — 3 of FIG. 1.

FIG. 3 is a cross-sectional view of the forespar assembly 36, taken just above a strut 62 which is shown in a fragmentary view. Forespar assembly 36 includes a tubular spar 78 enclosed by a fairing case 80. Forespar assembly 36 rotates in its entirety about the vertical axis of spar 78. Fairing case 80 encloses from the elements the jibsail track 82, the jib halyard, and auxiliary lines. Forespar assembly 36 is strengthened with spaced longitudinal forespar bands 60 spread apart on short horizontal struts 62, as shown in FIG. 1. Fairing case 80 is reinforced by ribs 84 and braces 86.

Figure 5:
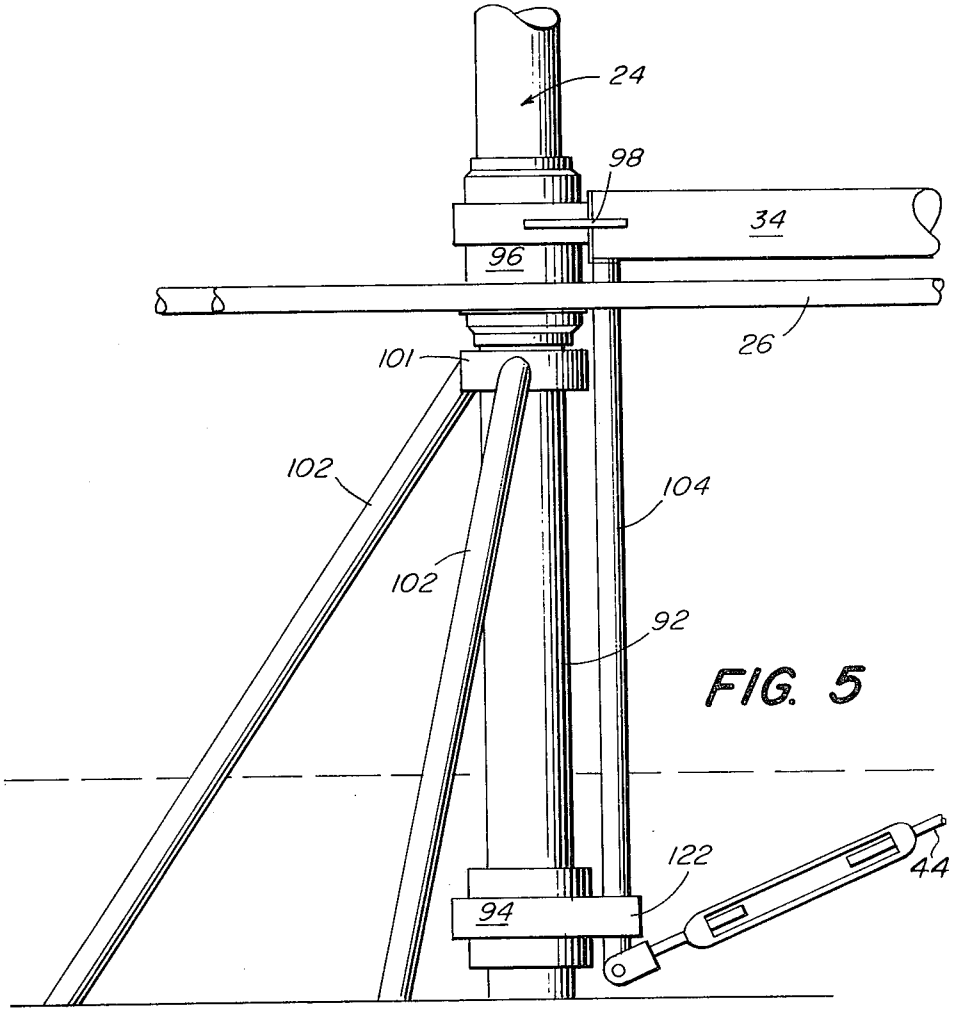
FIG. 5 is a view of the structure of the step.
Figure 4:
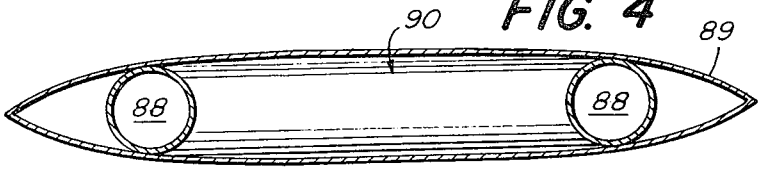
FIG. 4 is a cross-sectional view of the carrier boom taken along the line 4 — 4 of FIG. 1.
Figure 6:
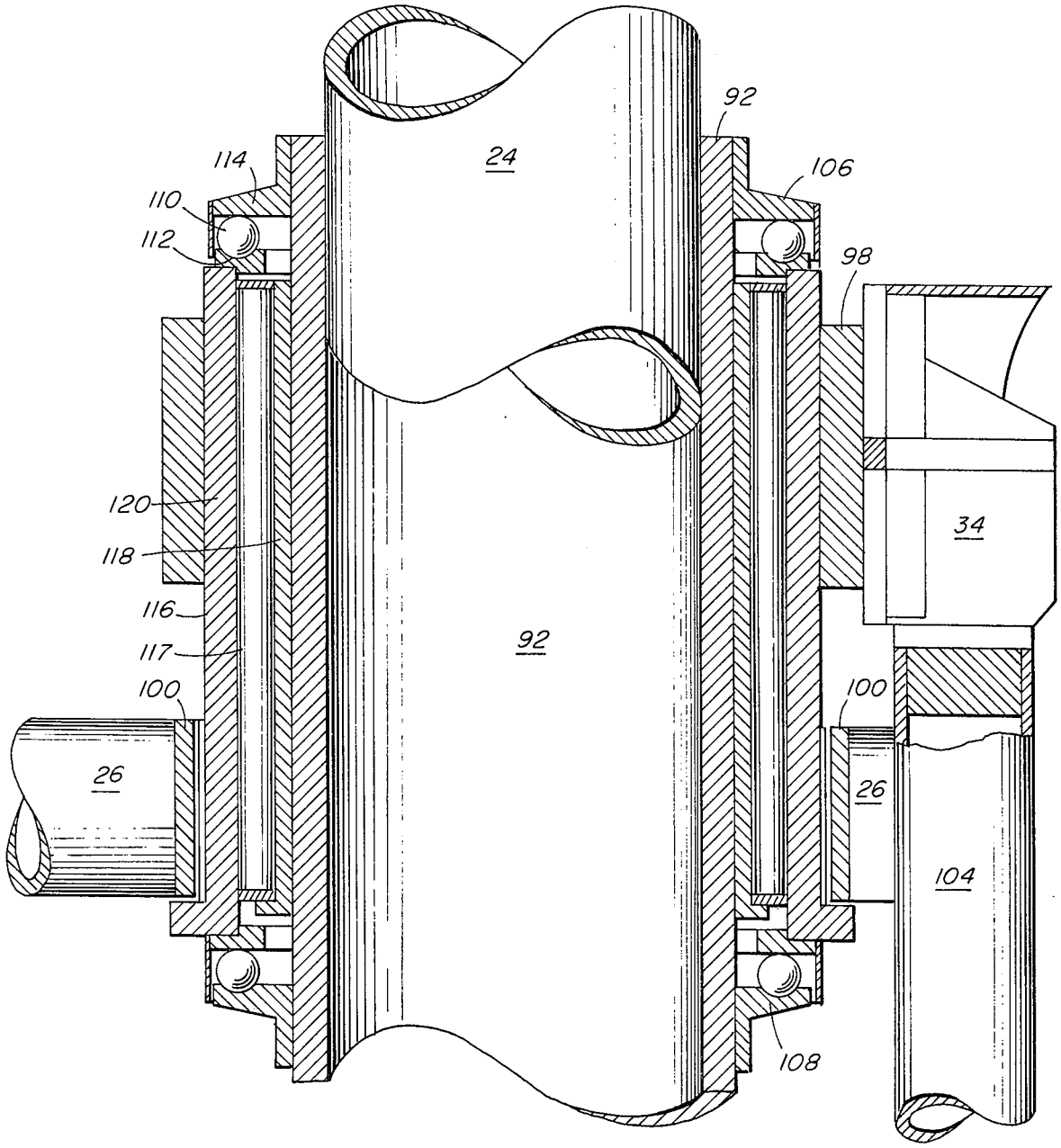
FIG 6 is a vertical section taken along the line 6 — 6 of FIG. 1 showing details of the main bearing assembly.

FIG. 4 is a cross-sectional view of carrier boom 26. Carrier boom 26 has two longitudinally oriented tubular spars 88 encased in a fairing 89, said tubular spars being held in shape by web struts 90. Carrier boom 26 has a central opening (not shown) to permit it to rotate about the main bearing of step structure 22, as shown in FIGS. 5 and 6. It also has an arcuate opening in the fairing, (not shown) just aft of the main bearing assembly to permit compression strut 104 to pass through freely, as shown in FIGS. 5 and 6.

FIG. 5 is a side view illustrating the general assembly of step structure 22, which is a stiff structure bedded to the hull 12 at the foot of mast 24. It comprises a step housing 92 which fits snugly about the foot of mast 24 surrounded at its base by a lower bearing 94 and just above by a main bearing 96. Both bearings 94 and 96 rotate about step housing 92 as will be described hereinafter. Mainsail boom 34 is attached by a load spreader 98 to the upper portion of main bearing 96. Carrier boom 26 bears on a fitting near the base of main bearing 96 and is separated therefrom only by a wear ring 100 (FIG. 6). Immediately below main bearing 96 is a fitting 101 which anchors three struts 102 (two shown). Struts 102 from fitting 101 to hull 12 support the step housing 92. A fourth compression strut 104 is set from a fitting 122 on lower bearing 94 vertically upward through carrier boom 26 to mainsail boom 34. Vang 44 is also attached to the base of compression strut 104.

FIG. 6 is a sectional view of the basic structure of main bearing 96. The internal structure of lower radial bearing 94 is essentially the same except for differences in length. FIG. 6 illustrates the base of mast 24 within step housing 92. Upper and lower thrust bearings 106 and 108 are provided to take the axial loads of rig 20. Thrust bearings consist, in a specific case, of a plurality of ball bearings 110 running in a groove 112. The upper race is 114 planar and makes "point" contact with the balls 110. Between thrust bearings 106 and 108 is the radial bearing 116, which has a plurality of rollers 117 vertically oriented and positioned between an inner race 118 and an outer race 120. The load spreader 98 of the mainsail boom 34 is fixed to the outer race 120 of radial bearing 116. The carrier boom 26 is separated from outer race 120 of radial bearings 116 by a wear ring 100. The step housing 92 is held in position by fitting 101, to which struts 102 are welded. Compression strut 104 is also shown as passing between tubes 88 of carrier boom 26 to mainsail boom 34.

The construction of lower bearing 94 is identical with that of upper radial bearing 116 except for differences in size and in fitting 122 to which compression strut 104 is attached.

The automatically rotatable sloop rig described is responsive to shifts in the wind direction and permits tuning of the sails. This tuning imposes additional forces on the spars of any rig, automatically rotatable or not. The structure described, and in particular the step structure, is designed to resist these high forces yet permitting the carrier boom and associated rigging to freely rotate about the vertical axis of the mast. While particular claimed spars have been described, standard spars now sold may be utilized. But, the carrier boom and the step structure must be fabricated in the novel manner herein described.

As shown in FIG. 1, a boom-to-helm link 124 is a rudder automatic controller, which is simply a stick with a plurality of holes drilled therein, and adjustably secured to the fore end of extended helm 18 and to some point on carrier boom 26. Boom-to-helm link 124, and the extended helm 18, could slow down the responsiveness of sloop 10, but then also obviate possible excessive speed loss due to high frequency rudder oscillation in unusually gusty winds. Hence, with link 124 in commission, transient wind deviations are more or less attenuated and filtered out by rig 20, and the generally desired course is held with respect to the wind.

Sail sheets 48 and 50 on the automatically rotatable rig 20 are used to set the foil-boom angles. Thus said sheets 48 and 50 (or the tackle to which they are all cleated) determine the angle of attack — the total sail force — over a wide range of existing wind speeds. This is an important change to the wind driven vessel, as for thousands of years sails were sheeted or braced to the hull, and the helmsman then used the rudder (or paddle) to adjust the attack. For instance, when the Master ordered: "Keep her full and by the wind," he was instructing the helmsman alone to maintain a high attack, but below stall, after the sails had been set close hauled to the hull by others in the crew. When the wind shifted and the sails shook at the luffs, the helmsman hardened up, steered the vessel farther off the wind, so as to increase the attack and fill the sails again.

Figure 9:
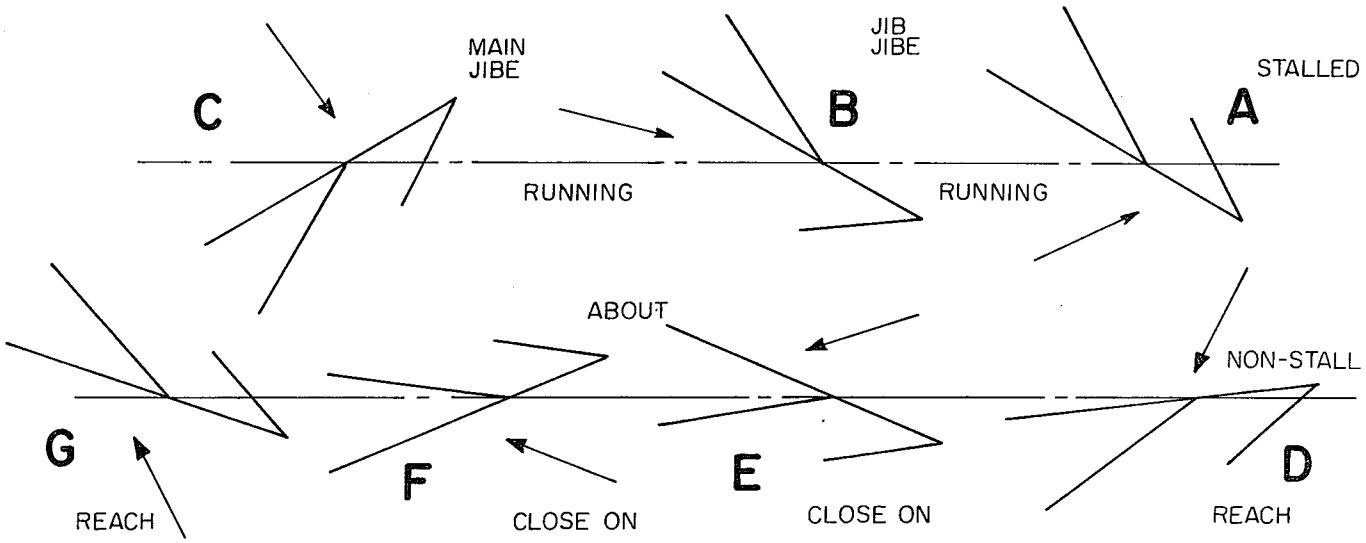
FIGS. 9 A, B, C, D, E, F, and G are diagrams showing the positions of the carrier boom and sails automatically assumed as the rig circles repeatedly.

Instead, as the auto rig 20 rotates to follow the shifting wind, or as the helmsman steers the boat, the geometric angle of attack remains fixed. (Except of course when a carrier boom 26 limit line (not shown) constrains the sails to stall, as when running, for instance. FIG. 9)

Figure 7:
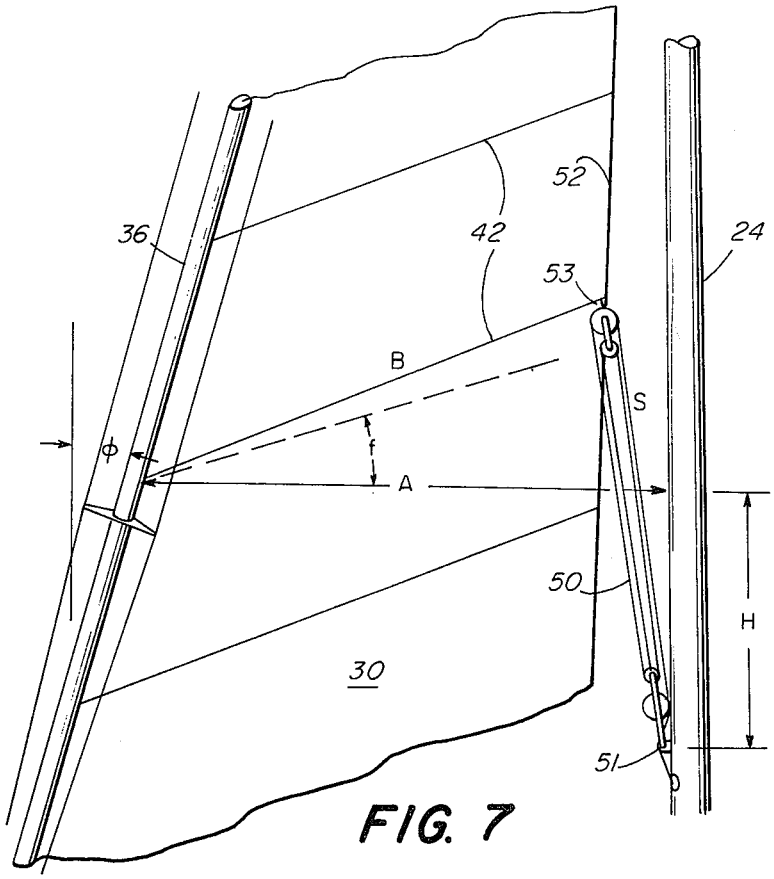
FIG. 7 is a fragmentary view of the jib showing the arrangement of one of the multiple jib sheets.

FIG. 7 shows the arrangement of the typical jib sheet 50, which in this particular case is the No. 3, four-strand sheet. The indicated symbols are defined as follows:

A is the horizontal distance between the axis of forespar 36 and the sheet anchor 51 on mast 24.

B is the horizontal distance between the axis of forespar 36 and the sheet fastening 53 at the leech 52 of jib 30.

H is the vertical distance between the sheet anchor 51 on mast 24 and the sheet fastening 53 on the leech 52 of jib 30, when the foil boom angle is zero.

S is the effective length of the jib sheet 50, that is, the length between the sail fastening 53 and the anchor 51 on mast 24.

$f$ is the foil-boom angle measured in a plane normal to mast 24.

$\phi$ is the angle between the inclined forespar 36 and mast 24.

The arrangement shown on FIG. 7 is efficacious because the main sheet 48 and four jib sheets 50 may be controlled with a single tackle or winch to alter equally the mainsail 28 and jib 30 azimuthal angles with respect to the carrier boom, called the foil-boom angles $f$.

As an example, the distances A, B and H are specified for a sloop rig of 600 square feet, on which certain jib battens 42 and therefore the jib sheet fastenings 53 are located at 0/9, 1/9, 3/9, 5/9, of the vertical span of the jib 30. FIG. 1 shows the general arrangement.

Table I

| | | Sail Sheets Specification | | | |
|---|---|---|---|---|---|
| Sheet | $\phi$ | Strands | A | B | H |
| Main | 0 | 3 | 102.4 in. | 162.4 in. | 4.0 in. |
| #1 Jib | 15.9° | 4 | 125.1 | 80.2 | 4.0 |
| #2 Jib | " | 3 | 128.0 | 124.0 | 60.0 |
| #3 Jib | " | 4 | 96.0 | 93.0 | 45.0 |
| #4 Jib | " | 6 | 64.0 | 62.0 | 30.0 |

Table I-continued

| Sheet | φ | Strands | A | B | H |
|---|---|---|---|---|---|
| | | Sail Sheets Specification | | | |
| Main* | 0 | 3 | 92.6 | 131.1 | 4.0 |
| Then, df/dS is the same for all five sheets 48 and 50 at a given foil boom angle (not for Main*, as explained hereinafter). | | | | | |
| f | 29.0° | | 43.9° | 59.0° | |
| df/dS | 0.606 | | 0.562 | 0.577 Degree/Inch | |

That is, the sheet length is increased about 1 inch to increase the foil-boom angles by 0.6 degrees. Or, at the helm, all sheets 48 and 50 are payed out five inches to increase the foil-boom angles by one degree, since the differential multiplication of travel by the blocks of all the sheets 48 and 50 is uniformly three.

The relationship between boom-jib angle and the commanded jib angle of attack is:

$$\text{Boom-Jib Angle} = 41.7^\circ - 0.58\ (\text{Jib Attack}^\circ) + (20.4^\circ)^2/(\text{Jib Attack}^\circ) \quad (2)$$

Equation 2, above, is an approximation of Equation 5, U.S. Pat. No. 3,968,765.

This particular operating characteristic was designed and later measured for a specific rig. It is most difficult to measure the angle of attack, because of the upwash, and said angle is obtained in a roundabout fashion. A similar characteristic may be altered a priori, but only little ex post facto (by providing several seats for the forespar 36 in the carrier boom 26, fore end.)

It is efficacious aerodynamically, and moreover easily practical, to maintain a higher geometric angle of attack on the mainsail 28, compared with the attack on the jib 30. This is called positive decalage, and it reduces interference between the jib 30 (upper wing) and mainsail 28 (lower wing). The upwash on the jib (upper wing) is stronger, and sailors have found that this sail therefore draws more in proportion to its area. That is, due to its juxtaposition, the jib 30 has its average dynamic wind pressure boosted higher than that of the mainsail 28. (Also, there is a modicum of confusion about the so-called slot effect between mainsail and jib. Early airplane wings were built with slots near the leading edge, but this whole idea was abandoned for valid aerodynamic reasons.) The jib 30 stalls first with increasing angle of attack both in the wind tunnel and fullscale, unless the jib attack, geometric of course, is lower than the mainsail's about as follows:

$$\text{Mainsail Attack} = 1.10\ (\text{Jib Attack}) \quad (3)$$

The optimum factor in Equation 3 might in fact be higher than 1.10, especially if the aspect ratio of the sails is lower than drawn on FIG. 1. However, the best practical way for a sailor to tune his rig is pragmatically — by measuring how fast the boat goes, with a systematic tuning procedure (marked sheets).

Along with Equations 2 and 3, the following equations state the applicable geometry:

$$\text{Wind-Attitude of Boom} = \text{Foil-Boom Angle} + \text{Attack} \quad (4)$$

$$\text{Effective * Relative Wind Angle} = \text{Wind-Attitude of Boom} - \text{Boom-Boat Angle} + \text{Leeway} \quad (5)$$

* Not at the main truck. And the Boom-Boat Angle, above, is said to be positive when the after length of the carrier boom 26 is to windward, as on a tack close on the wind. (FIG. 9). Then, the wind angle is crucial, and long tracts have been written about how to manage the boat to windward, all of them applicable to the conventional rig, not to the auto rig 20.

Equations 2, 3, 4 and the required sheet lengths are conveniently expressed in tabular form. Here, the main sheet 48 is located as defined by "Main*" in Table I, and it is this manner of location that maintains the positive decalage at all angles of attack.

TABLE II

| Geom. Jib' Attack | Geom. Main' Attack | Boom-Jib' Angle | Sail Tuning—Auto Rig: Boom-Main Angle | Wind Attitude Of Boom | #2 Jib Sheet Length | Main Sheet Length |
|---|---|---|---|---|---|---|
| 3.0' | 3.3° | 46.8° | 46.5° | 49.8° | 120.8" | 95.2" |
| 4.0 | 4.4 | 44.5 | 44.1 | 48.5 | | |
| 6.0 | 6.6 | 41.6 | 41.0 | 47.6 | | |
| 9.0 | 9.9 | 38.8 | 37.9 | 47.8 | | |
| 12.0 | 13.2 | 36.4 | 35.2 | 48.4 | | |
| 15.0 | 16.5 | 34.4 | 32.9 | 49.4 | | |
| 18.0 | 19.8 | 32.4 | 30.6 | 50.4 | 95.5" | 69.9" |
| +15.0' | +16.5° | −14.4° | −15.9° | 49.0±1.4° | −25.3" | −25.3" |

"Boom" above means carrier boom 26. Sheet lengths are for a rig of 600 ft.$^2$

As listed in Table II, the geometric angle of attack is determined on each of the mainsail 28 and jib 30 by properly designing the location of all the sheet anchors 51. The locations of the sheeted jib battens 42 shown on FIG. 1 are at 0/9, 1/9, 3/9, and 5/9 of the vertical span of the jib 30. And the locations of all anchors 51 are defined in Table I. Then, a change in foil-boom angle divided by a corresponding change in sheet length is as desired to maintain the decalage at all angles of attack, even though individual sheets 50 may be displaced a few inches to correct for structural deflections.

By contrast with wind-tunnel tests, it is practically impossible to measure the geometric angle of attack on the full scale foil, what with the fickle wind. See FIG. 10. One can but measure the time-averaged lift and drag on the stationary rig with an untwisted wind. Instead, for accuracy in tuning the sails 28 and 30 on water, the main sheet 48 and No. 2 jib sheet 50 are better set at the dock with the help of a tape rule, as a sailboom angle of 45° or so, and these two sheets are not re-adjusted during subsequent routine tuning under way. The other three sheets 50 and the vang 44 suffice to control the shapes of the sails 28 and 30. This can be done by eye, of course, or by reference to the more unbiased criterion; ratio of water speed to wind speed.

Alternatively, if a sailor wishes to man the main sheet 48 separately from the multiple jib sheets 50 (a large yacht with accurate instruments and careful supervision could profit from this method of control), the mainsheet anchors 51 can easily be re-located on the mainsail boom 34 and carrier boom 26 so as to set the boom-main angle exactly as the boom-jib angle is set. See Table I.

Note that the sheets 48 and 50 have 3 to 6 strands, or different numbers of blocks to multiply their travel below deck to make it possible for all sheets to be operated as a unit, not primarily to multiply force. For only the main sheet of any sizable rig exerts tension requiring mechanical advantage. But when the jib is struck, about 120 feet of ⅛ inch line reeves through the blocks of the six-strand, No. 4 jib sheet 50 in order to let that sail down. The No. 3 and No. 4 jib sheets 50 are then started from the control tackle; the other, more crucial, remain as tuned.

Three of the four jib sheets 50 exert tension on the leech 52 of jibsail 30, though not much. However, the vertical span between the sheeted battens 42 is relatively short, and any localized deflection of the leech 52 is of only minor importance in respect of the general shape of the jib 30.

Note in Table II that the wind-attitude of the carrier boom 26 is 49.0 ± 1.4° over the operating range of attack. The carrier boom 26 is the most reliable wind instrument aboard the boat, for its dead zone is normally shaken out by any wave action at all. There is no need to watch the luffs (unless of course the rig is so badly out of tune that one or the other shakes steadily). Instead, the helmsman watches the boom-boat angle and perhaps the water surface to windward in gentle breezes. Said angle is easily measured with a marked stick and the Cosine Law.

From Equation 5, one may deduce that the effective relative wind angle may be closely approximated if both the carrier boom-boat angle and leeway are known. Measuring the leeway presents some difficulty with a fixed keel boat; where said angle may be as high as 5° or 6° to windward. But after the sailor has calibrated his boat to windward, he may just as well use the angle of carrier boom 26 and the water speed or ratio of water speed to wind speed, as prime information requiring no further processing. The sheets 48 and 50 may require tuning, and the carrier boom supplies the basic information needed to avoid falling off the wind too much on a long board. Table II shows why.

In connection with trimming any sail for sailing to windward, there is a qualitatively different limitation on the boat's windward career, and this is a form of hydrodynamic instability caused by the keel's behavior against a wind too close. For purpose of explanation, one can assume the keel area is elliptical in planform and large enough to assure non-stall operation on any point of sailing however close on the wind. Also one can assume that the keel is rotatable or has a large flap so that the hull may operate with substantially zero leeway. (These simplifying assumptions obviate mathematical complications but are not really needed to arrive at the general conclusion.) Then the minimum operating angle of the relative wind, here equal to the true wind angle since the water speed approaches zero, may be called the Wind Pinch Angle, as follows:

$$\text{Wind Pinch Angle} = \text{ArcTan}({}^{C}D/C_L)\ (\text{Aero}) + \text{ArcTan}([2(LWL)\ (f(Re)/Pi)^{0.5}]/\text{Keel Vertical Span})\ (\text{Hydro}) \quad (6)$$

where $C_D$ is the total wind drag coefficient of the entire vessel, both parasitic and induced, $C_L$ is the lift coefficient of the sails, LWL is the load waterline length, and $f(RE)$ is the dimensionless function of water Reynolds number used to correlate hulls' parasitic water drag, said drag being equal to: $f(Re)$ $(LWL^2)$ (Water Speed$^2$) (Water Density)/2g, at zero leeway but not necessaily at zero heel. Keel Vertical Span is the measureable draft from hull to lower tip.

Rating rules limit the keel span, for instance, to about $0.15(LWL)$. $f(Re)$ averages about 0.0014 for hulls operated at low water speed. Hence, the second term on the right of Equation 6 is ArcTan $((2/0.15)\ (0.0014/Pi)^{0.5})$ = ArcTan(0.281) = 15.7°. This is the hydro effect.

The first term on the right of Equation 6 measures the aerodynamic inefficiency of the entire craft, and with care in design, construction and sail tuning, it could be reduced to eight to ten degrees. This is the aero effect. Hence, the sum, the Wind Pinch Angle, is 23° to 26°.

To correct for the varying upwash in the pinch is hopeless without the help of a wind tunnel over a water tank. Suffice it to say that the usual boat decelerates into irons, or cannot accelerate, when the true wind is 25 to 30°, with the result that even skillful helmsmen beating to windward with a relative wind angle varying around 30° are often pinched in because of the shifting wind. See FIG. 10. Water speed plummets with but a few degrees shift in way of a header. So the usual reaction is to bear off too far in order to maintain water speed, at a loss in speed made good. This was also an inherent fault of the speedy clipper ships, still unmatched on the beam reach but evidently not too smart on the long board.

With the automatically rotatable rig 20 working to windward, the first term of Equation 6 is substantially constant at any relative wind angle greater than said first term, which is reliably adjustable over a wide range of drag/lift ratio. (This condition is impossible to achieve with the conventional sloop rig whose lift coefficient depends on the varying angle of the relative wind.) Hence, the automatically rotatable rig 20 may be reliably hove to with any keel, either by carefully clamping the helm 18 off neutral or by setting the rudder automatic controller 124 to hold a course very close on the wind. Again, the boom-boat angle is the operating parameter to set, once the foil-boom angles *f* are tuned for the prevailing weather. ("Hove to" means here pinched in reliably, not by backing the jib sail.)

In general, these improvements comprise many details in construction and operation directed to maximizing the performance of the automatically rotatable said rig 20.

For instance, while beating to windward in a strong wind, the heel angle and its consequent water resistance may be reduced appreciably by either paying out the jib sheets 50 only a degree or two, or drawing in the main sheet 48 only a degree or two. This increase in positive decalage above that normally tuned in is accompanied by some decrease in total sail force, especially since the air induced drag and resulting heeling force are reduced to a greater proportional extent. However, on the beam reach, instead, excessive decalage does not affect the heel angle to a helpful degree; it simply slows the boat somewhat. For such fine tuning as this, well calibrated instrumentation is particularly useful.

Figure 8:
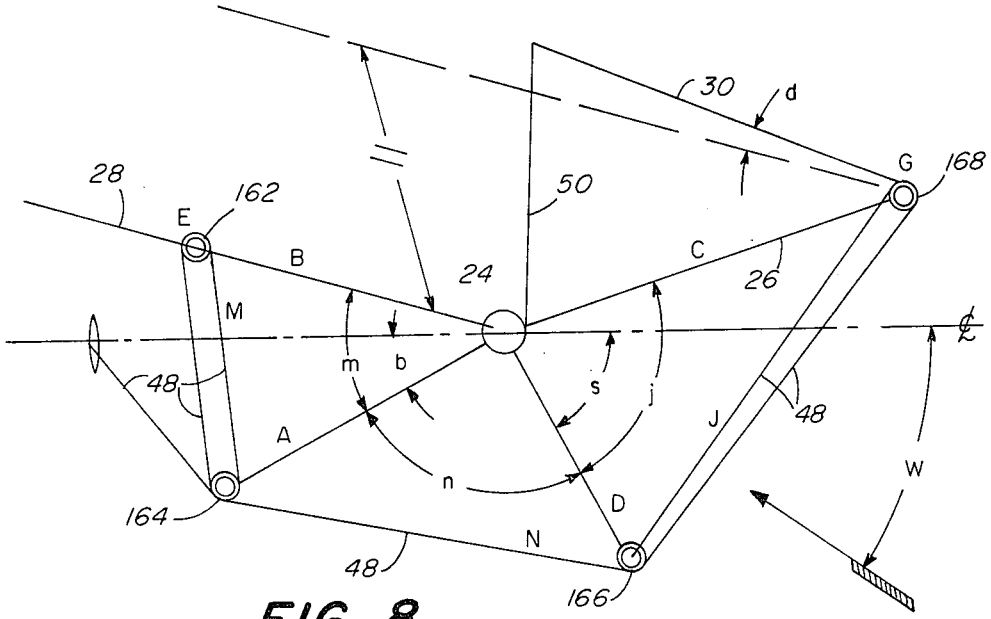
FIG. 8 is a diagram showing an alternative main sheet arrangement, suitable for sloop rigged catamarans particularly.

It is indeed possible and practical to adjust automatically the decalage, not only with respect to attack, as in Table II, but also with varying relative wind angle, i.e., with varying course, by using an alternative main sheet arrangement as shown in FIG. 8. The object is to reduce the induced drag when sailing high on the wind. Then, the induced drag and the drag/lift ratio are appreciably reduced with some reduction in total lift and heel. On the other hand, when necessarily sailing lower, the sails 28 and 30 automatically tune themselves to increase the total lift, for then wind drag is considerably less detrimental to the yacht's overall career.

Said alternative sheeting is particularly applicable to catamarans, which by inherent geometry have a broad deck suitable for mounting the blocks 164 and 166 through which the main sheets 48 are rove. A subsidiary advantage is that the after length of the carrier boom 26 is physically eliminated, at the expense of providing doubled main sheets 48, each of which must be located and manned separately to achieve identical operations on both starboard and port tacks. And, as shown, the main sheets 48 are manned separately from the jib sheets 50.

As a typical installation in the size of 600 square feet of sail, assume that the catamaran has a mainsail boom 34 situated four feet above the blocks 164 and 166 mounted on the deck ($E$ = 4 ft.), and that the carrier boom 26 is located 0.7 feet above the same level ($G$ = 0.7 ft.), so that eliminating the after length of the carrier boom 26 is practically a necessity in order to leave space for the crew to operate. On this basis, the lengths and angles depicted on FIG. 8 are chosen:

| | |
|---|---|
| A = 8 feet | b = 30° |
| B = 8 feet | |
| C = 11 feet | n = 90° |
| D = 6.4 feet | s = 60° (to locate the single jib block 166) |
| E = 4 feet | (height of mainsail boom above blocks 164, 166) |
| G = 0.7 feet | (height of carrier boom 26 above blocks 164, 166). |

$M^2 = 4^2 + 8^2 + 8^2 - 2(8)(8)\text{Cos}(m) = 144 - 128\text{Cos}(m) =$ Oblique length$^2$ on FIG. 8.
$J^2 = 0.7^2 + 11^2 + 6.4^2 - 2(11)(6.4)\text{Cos}(j) = 162.45 - 140.8\text{Cos}(j) =$ Oblique length$^2$ on FIG. 8.
$N^2 = 8^2 + 6.4^2 = 104.96 = 10.24^2$.
Mainsail Arm = (AB/M) Sin(m) = MA.
Jib Arm = (CD/J)Sin(j) = JA.

The sail arms defined above are effective distances that should balance the turning moments of the two sails 28 and 30, so that the entire rig 20 may rotate to follow the shifting relative wind. (Angle $w$ varies.) Hence these two arms must be close to equal, or the rig 20 must be purposefully unbalanced if they are not equal.

The calculation shown in Table III below is done by first choosing angle $m$, and from said angle is found the length M. Since M + J is a constant, which along with the jib sheets 50, determines the set angles of attack on the sails, J is next found by difference. And from length J, angle $j$ is computed. A small change in the sum ($j + m$) is equal to the change in boom-mainsail angle ($j + m + n - 180°$) as boom-boat angle ($j - s$) is varied. Said change in ($j + m$) is the negative of the change in decalage $d$, provided the jib sheets 50 remain as set while the entire rig 20 rotates on its free bearings 94 and 96 to follow the shifting wind or the maneuvers of the helmsman or both. The magnitude of the change is decalage $d$ is voluntarily adjustable by setting the location of the single jib block 166 shown on FIG. 8, that is by adjusting the length D. Also, as rig 20 is rotated by hand at the dock, this small change in ($j + m$) is reliably measurable. In mathematical terms, the function of ($j + m$) with boom-boat angle, or with relative wind angle $w$, or with course, is adjustable over a wide span and is measurable once set.

TABLE III

| m | M | J | J + M | j | MA | JA | Decalage |
|---|---|---|---|---|---|---|---|
| 90° | 12.00' | 6.36' | 18.36' | 30.00° | 5.33' | 5.54' | 0.3° |
| 75 | 10.53 | 7.83 | " | 44.08 | 5.87 | 6.26 | 1.2 |
| 60 | 8.94 | 9.42 | " | 58.43 | 6.20 | 6.37 | 1.9 |
| 45 | 7.31 | 11.05 | " | 73.35 | 6.19 | 6.10 | 1.9 |
| 30 | 5.76 | 12.60 | " | 88.50 | 5.56 | 5.59 | 1.8 |

The boom-boat angle is $j - 60°$, and this varies over the span from $-30°$ to $+28.5°$. Decalage, $d = 120.3° - j - m$, and the constant = 120.3° is set by means of the jib sheets 50.

Each of the two main sheets 48 has a length of $2J + 2M + N = 47$ feet. This long length of line should be relatively stout to limit stretch. For stretch has the effect of increasing the boom-mainsail angle, decreasing the decalage $d$, during wind puffs. So, increased wind pressure is accompanied by an increase in the effective angle of attack, and this deleterious phenomenon should be held within acceptable limits. On the other hand, stretch of the jib sheets 50 has the effect of increasing the decalage $d$, thereby lowering the effective angle of attack, and this is as it should be.

As calculated in Table III, the change in decalage $d$ is 1.5° (or 1.6°) when the entire rig 20 rotates through an angle of 58.5°. If it is desired to augment the change in decalage $d$, the single jib block 166 is set farther from the mast 24; D is increased beyond 6.4 feet. For instance, if D is increased to 6.6 feet (a shift of 2.4 inches) the change in decalage $d$ becomes 3.4° for the same span of rotation of the entire rig 20.

FIG. 9 is a diagram of the positions assumed by the spars of the automatically rotatable rig 20 as the boat circles repeatedly. In order for the boat the change tack on the wind and jibe automatically, as shown, the auto rig 20 must be fitted with a limit stop. This stop permits the rig to rotate freely over a limited span of azimuthal angle. Said stop is designed so that the maximum allowable boom-boat angle as defined earlier is equal to mainsail-boom angle voluntarily set on the rig 20.

The stop may be a limit line set in any convenient location. Usually the best fastening for said line is on the fore length of carrier boom 26, and its anchor is on the centerline of the hull 12 on deck. Since this line is conveniently cleated to the same control tackle as are sheets 48 and 50, it should have the same tuning differential as the sheets, which is shown by study of Table I. In other words, when the mainsail foil-boom angle is changed by plus 1°, the maximum boom-boat angle is also changed by plus 1°. Distances corresponding to A, B, and H of Table I are similarly specified for the limit line. And said line must run freely in its blocks, in order to obviate possible upsets in the angle of attack.

Instead of a limit line, cushioned mechanical stops may be used to limit the free rotation of fig 20. In either case, said stops permit the rig 20 to change course from any tack to any other tack by manning only the helm leaving all the sheets 48 and 50 cleated and the vang 44 set for the average point.

Rig 20 may be tuned by eye as it circles repeatedly with a clamped helm 18 and the stops set.

Figure 10:
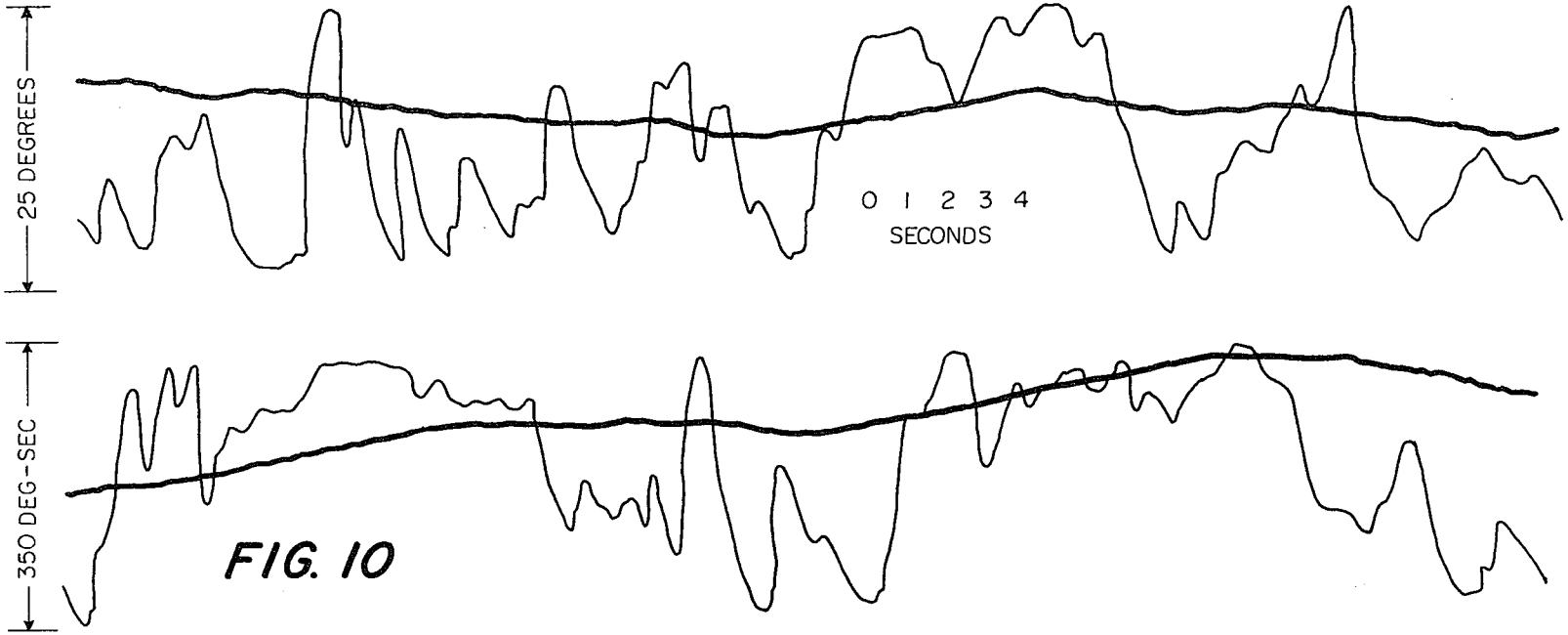
FIG. 10 is a wind trace, showing direction as deviations from the mean and its time-integral recorded mechanically.

The directional deviations of a typical sailing wind are shown on FIG. 10. Sometimes the wind deviates much more from its mean direction, at higher average frequency.

Study of many such traces reveals that the massive hull of a sailboat cannot change course rapidly enough to follow the higher frequency deviations. Fortunately these are usually of low amplitude. However, rotatable rig 20, being much less massive, follows the directional deviations more closely, and so the strategy at the helm 18 is appropriately altered to take advantage of heretofore unavailable wind energy that can be converted to forward thrust. This is the subject matter of Patent Number 3,830,183.

The trace shown on FIG. 10 was obtained with a wind vane having low polar inertia and negligible dead zone. This is made clear, as experienced siilors and boat builders are invariably appalled by FIG. 10 and similar traces. Nevertheless, these data, along with reported wind speeds, represent the basic input to the detailed design of the automatically rotatable rig 20.

The automatically rotatable sail rig operates by always balancing the horizontal sail forces, their moments actually, about the vertical axis of the freely rotating step. This balance of moments is written:

| | | |
|---|---|---|
| Sum of: | $/LAC_L Sec(n) Cos(a+m+f-n)/_j Ft^3$,for instance | |
| − Sum of: | $/EAC_L Sec(n) Cos(a-n)/_j$ | |
| = Sum of: | $/LAC_L Sec(n) Cos (a+m+f-n)/_z$ | |
| + Sum of: | $EAC_L Sec(n) Cos (a-n)/_z$ | |
| + Sum of: | $/CAC_M/_j$ | |
| + Sum of: | $/CAC_M/_z$** | (7) Equation 5 of Patent NO. 3,968,765 is an approximation of this. |
| n = | ArcTan $(C_D/C_L)$ | (8) Equation 4 of the same patent. |

The subscript *j* denotes airfoils whose axes of rotation are located forward of the step on the centerline of the carrier boom, and *z* aft of the step on the same centerline.

L = distance of the axis of rotation of an airfoil, along the centerline of the carrier boom, from the axis of the step — always positive in the above equation. For the sloop rig, the single $L_z = 0$, since the axis of rotation coincides with the axis of the step, for the mainsail.

A = planform area of an airfoil, (airplane nomenclature)

$C_L$ = lift, or thrust, coefficient of a clean airfoil, a function of camber, attack, aspect ratio, and proximity to other airfoils (airplane nomenclature).

$C_D$ = drag coefficient, the sum of parasitic and induced drags, a function of Reynolds number, camber, attack, aspect ratio (the "equivalent monoplane aspect ratio" according to Prandtl), and proximity to other airfoils. (airplane nomenclature)

E = distance of an airfoil's center of air effort from its own axis of rotation — always positive. At zero attack, this center is at mid-chord. It moves abruptly upstream at low attack to about the quarter point of the chord, where it remains more or less fixed with increasing attack until stall is reached. At angles of attack beyond stall it moves downstream to the midchord again.

$C_M$ = pitching moment coefficient, a function of camber, especially, attack, and proximity to other airfoils. (airplane nomenclature)

C = average chord of an individual airfoil. (airplane nomenclature)

*a* = geometric angle of attack, unperturbated by the upwash, or "angle of attack", or "attack".

*m* = offset angle of an airfoil's center of effort, off the airfoil's effective plane by reason of camber, usually small.

*f* = foil-to-boom angle, the angle between the longitudinal centerline of the carrier boom and the effective plane of an airfoil. Since the sail is twisted, the "effective plane" is only a geometric approximation taken at the elevation of the foil's center of air effort.

*n* = drag angle of an airfoil, a measure of aerodynamic inefficiency. In the case of the auto rig, the drag angle of the entire rig (not of individual foils) is easily measurable.

Angles *f*, *m*, and *n* are always positive in the above equations. Angle *a*, and thus coefficient $C_L$, could conceivably be negative, but not with conventional cloth sails, in which case *a* is zero or positive.

At small attack, $C_L$ approaches zero and *n* approaches one-half-Pi, or 90°. Then $C_L Sec(n)$ approaches the parasitic drag coefficient since the induced drag approaches zero also.

When the chamber is restrained to be always low, by means of the conventional battens, $C_M$ is small and the rig operates stably over a wide range of $C_L$. A range of $C_L$ was measured to be 0.2 to 1.5 for a sloop rig of 100 square feet, with stable operation. At lower lift or thrust the sails shook sometimes, because of high-frequency wind deviations in angle.

The principal use of Equations 7 and 8 is in determining *f* as a function of *a*, or what foil-to-boom angle to set by hand for a desired said thrust and drag with a trial sail configuration. If said function is not satisfactory, the spars or sails or both must be changed. Such a function is presented earlier as Equation 2.

The objective of the present work is to design the sails 28 and 30 according to the requirements of Equations 7 and 8 and to specify structures that permit the rig 20 to respond to the wind. For five thousand years that we know of, sailors have been trying to do this by trial and error.

Figure 11:
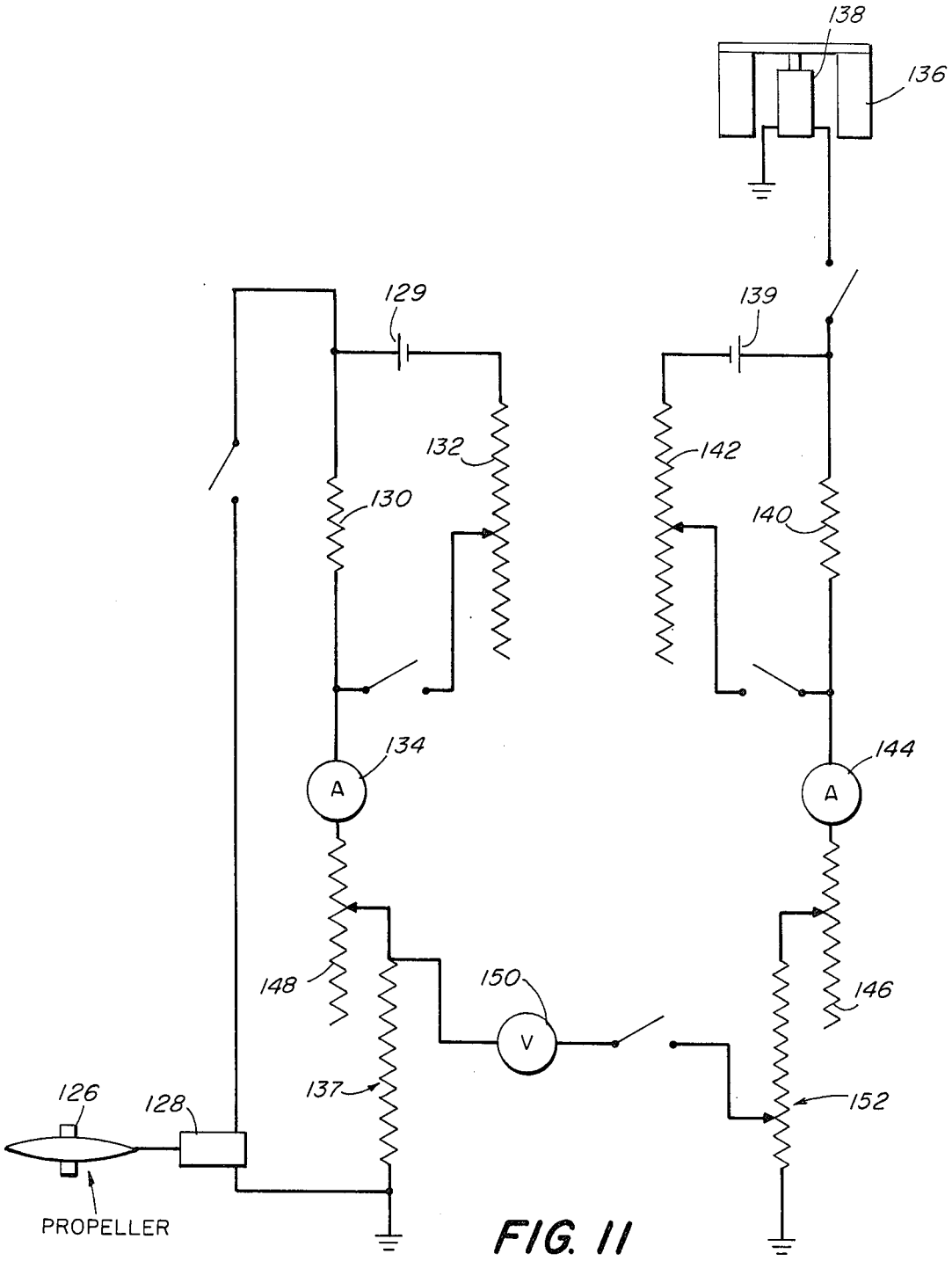
FIG. 11 is a schematic drawing of the electrical circuit used to indicate the ratio of water speed to relative wind speed.
Figure 12A:
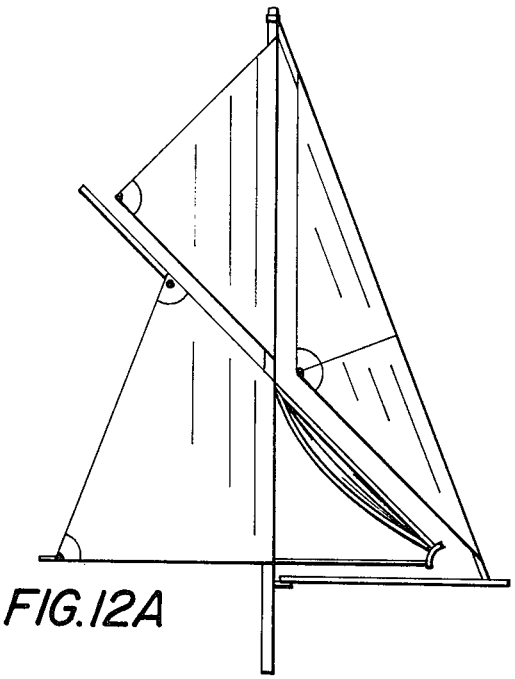
FIGS. 12 A, B, C, D, E, and F show the constructions of smaller automatically rotatable rigs.
Figure 12B:
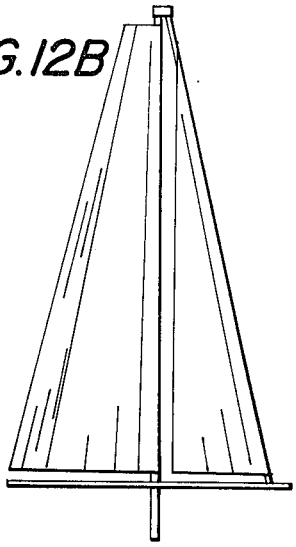
Figure 12D:
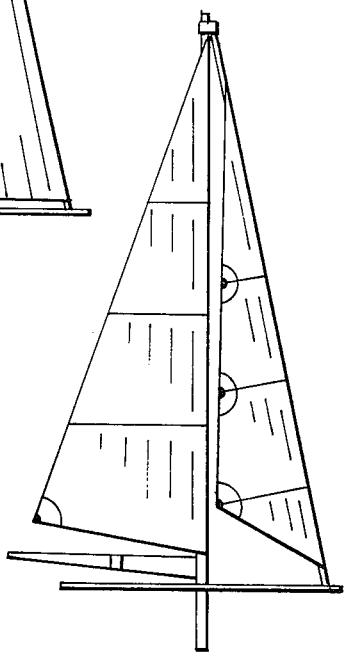
Figure 12E:
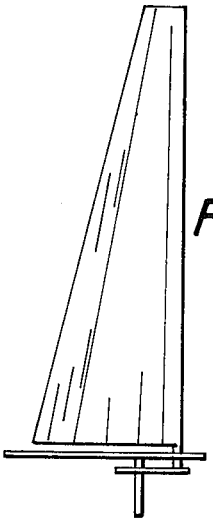
Figure 12F:
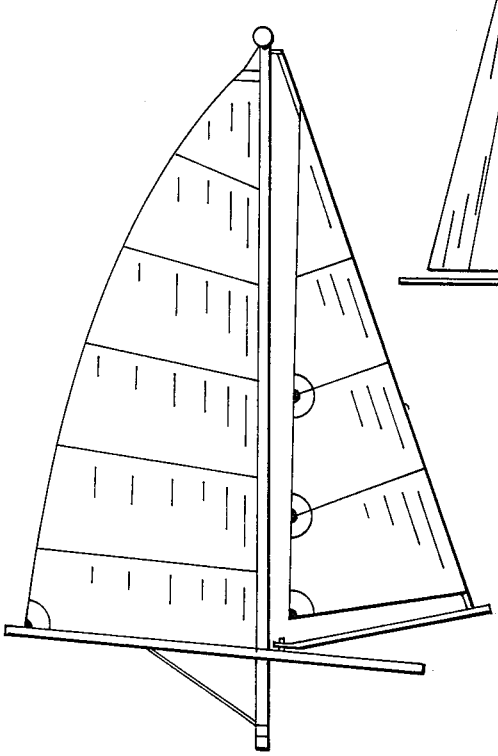
Figure 12C:
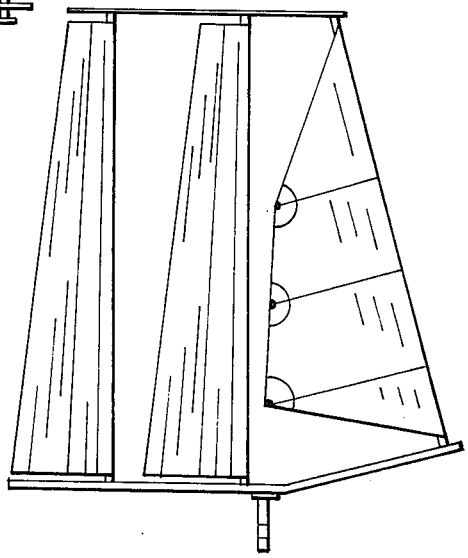

To maximize the speed of the rig described, a few simple instruments are useful. The most useful measurement a sailor needs to tune his sails is the ratio of water speed to relative wind speed. An instrumentation system that indicates the ratio is shown on FIG. 11.

A water turbine 126 drives a DC generator 128 in a circuit biased by a flashlight battery 129 and having a fixed resistor 130 and a variable resistor 132. An ammeter 134 reads the current in milliamperes and, in effect, the water speed in knots.

Likewise, an anemometer 136 drives a DC generator 138 in a similar circuit biased by a flashlight battery 139 and having a fixed resistor 140 and a variable resistor 142. An ammeter 144 reads the current in milliamperes and, in effect, the wind speed in knots. The two circuits each utilize a variable calibration resistor 146, 148.

A voltmeter 150 is used to equalize manually the voltage drops across the grounded resistors, thus to give an angular indication of the ratio of the set resistances on a reostat 152. This angle indicates the inverse ratio of the electric currents and the direct ratio of speeds, which is a pragmatic criterion of performance in light to moderate winds.

Instead of manually adjusting the reostat 152 to null the voltage as read by voltmeter 150, a simple servo system (not shown) may be used to turn the reostat 152.

Then, voltmeter 150 is replaced by a high-gain, integrated circuit, operational amplifier (not shown). Output from said amplifier is fed to the bases of a pair of common-emitter power transistors. The boosted current then drives a toy DC motor in either direction. Said motor has its shaft coupled through a gear reducer to the reostat, and the voltage is nulled continuously. Again, the ratio is read off a dial. Such a simple, high-gain servo tends to oscillate a bit about the null point, or the ratio point, but the reading is nevertheless quite accurate if properly calibrated and it is certainly precise.

Automatically rotatable rigs of small size, in the range from 40 to 200 square feet, could indeed operate, through less efficiently, with fewer components than have been described. FIGS. 12 A, B, C, D, E, and F show the constructions of small rigs that have performed well.

FIG. 12 A shows a construction that functions without standing rigging. It used no forestay, backstay, or shrouds. The rotatable mast was stepped in a bearing assembly consisting of a lower spherical thrust bearing and a water-lubricated journal higher up near the carrier boom. The step housing was supported by struts similar to struts 102 shown on FIG. 5. This rig could be assembled in minutes from a rolled-up parcel tied to automobile door handles. Sailing surfboards could use this rig. The hull was a catamaran-surfboard.

FIGS. 12 B and E show a general type of construction useful on sailsleds and sailcars. The sail or sails are relatively limber airplane-type wings, or relatively stiff sails, that operate with low wind twist because of the high speeds attained. Small sailcars carrying 1.5 square feet of said, ballasted on the windward wheel, traveled faster than any sailboat ever sailed or will ever sail, despite the low speed of the low-level wind. Fullscale sailsleds have traveled faster (143 mph?).

FIG. 12 D shows a rig using a mainsail boom welded to a sleeve outside the mast and projecting upward inside the mainsail luff, so that no vang is needed. This particular rig suffered excessive wear on the mast, due to friction by the sleeve, but presumably Teflon bearings could be used to eliminate the wear.

FIG. 12 C shows a structure that ultimately will prove most efficient aerodynamically. Wind tunnel test show that, from the aerodynamic standpoint, the required sail area is best split up into a number of high-aspect-ratio airfoils. What the optimum number is from all viewpoints remains to be determined. The *America,* for example, carried five airfoils.

FIG. 12 F shows an efficient rig for planing hulls, which can carry stout standing rigging but only a minimum of weight and no instrumentation. Planing hulls are always small and light. A standard aluminum mast section used on this rig is best strengthened by pouring its lower third full of sailboat resin, along with fiber glass mat. For safety, only the ganged jib sheets need to be started in an emergency.

In conclusion is should be said that an automatically rotatable rig must be accompanied by a deep keel, as Equation 6 states. Otherwise the inherent aerodynamic efficiency is lost to hydrodynamic instability close on the wind. This assumes rig 20 is used on water.

Rig 20 may also be used on land and ice, on sailcars and sailsleds.

A sailcar is a vehicle comprising:

a. A said rig, b. Three wheels or wheeled trucks, any of which are rotatable about vertical axes by means of a tiller or tillers, c. A cockpit, d. A frame to hold a), b), and c) together, and e. Movable ballast placed near any of the wheels or trucks.

A sailsled is a sailcar with the wheels or trucks replaced by runners.

I claim:

1. An automatically rotatable sail rig for a sloop comprising:

a stiff step structure bedded to the hull of said sloop;

an upper main bearing on said step structure having a pair of upper and lower thrust bearings separated by a radial bearing;

a lower bearing on said step structure having a radial bearing;

a single vertical, tubular mast assembly mounted at its foot within said step structure;

said mast assembly supporting a battened cloth mainsail along its luff;

a substantially horizontal carrier boom freely rotatable about the radial bearing of said upper main bearing and hence freely rotatable about the vertical axis of mast assembly; said carrier boom having its angular span of free rotation limited by means of a line attached to the fore end of said carrier boom and attached to the hull along its centerline, said attachments being designed to permit the boat to be operated without adjusting sail sheets and said limiting line when making course changes, such as going about, jibing, changing from any tack to any other tack, and circling repeatedly, by manning only the helm or tiller;

a rotatable, tubular, inclined forespar assembly mounted at its lower extremity on the fore end of said carrier boom and at its upper extremity near the head of said mast assembly;

said forespar supporting a battened cloth jibsail along its luff;

a tubular mainsail boom to accomodate the foot of said mainsail;

the fore end of said mainsail boom being secured to said upper main bearing by a load spreader;

said step structure mounting said mast, said carrier boom, said forespar and said mainsail boom;

a vang to pull a weather-varying tension on the leech of said mainsail;

said vang being made fast at its extremities to said mainsail boom and to the lower bearing of said step structure;

a main sheet between said mainsail boom and said carrier boom to control the angle of said mainsail with respect to said rotatable carrier boom;

a coordinated system of multiple jib sheets made fast to said jib battens to shape the jibsail generally and to control the angle of said jibsail with respect to said carrier boom and to said mainsail;

a forestay set from the masthead to the nose of the hull to resist the horizontal moment of tension imposed on the leech of said mainsail;

a plurality of athwartships shrouds to support said mast assembly;

said forestay and said shrouds being flexibly anchored to said hull to permit free rotation of said spars, sails, vang, sheets, and carrier boom.

2. The automatically rotatable sloop rig of claim 1 wherein said mast assembly further comprises:

a tubular spar whose wall thickness decreases with its height;

a fairing case enclosing said tubular spar;

said fairing case rotating about said spar;

said fairing case so constructed as to shield from the wind the mainsail track, the main halyard, the jib sheets and other auxiliary lines.

3. The automatically rotatable sloop rig of claim 1 wherein said carrier boom further comprises:

two tubular spars held in a spaced apart relationship by web struts;

a fairing case enclosing said tubular spars and said web struts;

a central circular opening lined with wear rings to permit said carrier boom to rotate about the main bearing of said step structure;

an arcuate opening in said fairing to permit a compression strut from said lower bearing to said mainsail boom to extend therethrough;

said carrier boom rotating about the main bearing of said step structure and thus about the vertical axis of said mast assembly;

said carrier boom mounting at its fore end the forespar along with its jibsail and mounting at its after end the main sheet fastening so that one sail is spread before and the other sail spread after the vertical axis of rotation of said sloop rig to balance their turning moments.

4. The automatically rotatable sloop rig of claim 1 wherein said forespar assembly further includes:

a tubular spar;

a fairing case enclosing said tubular spar to shield the jibsail track, jib halyard, and other auxiliary lines;

a plurality of short, horizontal struts attached to said spar;

a plurality of lateral, longitudinal bands spread on said horizontal struts to stiffen said spar;

said forespar rotating about its own axis when the jib sheets are manually adjusted and when the relative wind changes direction.

5. The automatically rotatable sloop rig of claim 1 wherein said step structure further comprises:

a step housing;

said upper main bearing being rotatable about said step housing;

a plurality of compression struts running from the base of said main bearing to the hull structure;

said lower bearing being rotatable about said step housing;

a compression strut from said lower bearing to said mainsail boom;

said bearings providing for low friction rotation as said rig follows a shifting wind;

said bearings fabricated to take the radial and axial loads imposed by said mainsail boom, by said vang, by said carrier boom and by said mast assembly.

6. The automatically rotatable sloop rig of claim 1:

whereby all sheets in said coordinated system of multiple sail sheets are lead to a tackle near the helm to adjust both said angles simultaneously with respect to said carrier boom;

said simultaneous adjustments being affected by providing multiple strands on each sail sheet appropriately reeved through blocks, and by providing accurately placed fastenings so that all sheets have the same rate of change of sail-boom angle with respect to sheet travel at said tackle.

7. The automatically rotatable sloop rig of claim 1 further utilizing a rudder automatic controller comprising:

a strut having a plurality of holes bored therein;

said strut being engaged with the helm at one hole and attached to the rotatable carrier boom at the other end.

* * * * *